US009273483B2

(12) United States Patent
Ceko

(10) Patent No.: US 9,273,483 B2
(45) Date of Patent: Mar. 1, 2016

(54) COMPOSITION FIBER GLASS UTILITY POLE

(71) Applicant: Trident Industries LLC, Chicago, IL (US)

(72) Inventor: Peter Ceko, Barrington Hills, IL (US)

(73) Assignee: TRIDENT INDUSTRIES, LLC, Chicago, IL (US)

( * ) Notice: Subject to any disclaimer, the term of this patent is extended or adjusted under 35 U.S.C. 154(b) by 0 days.

(21) Appl. No.: 14/035,512

(22) Filed: Sep. 24, 2013

(65) Prior Publication Data

US 2014/0096475 A1 Apr. 10, 2014

Related U.S. Application Data

(60) Provisional application No. 61/710,643, filed on Oct. 5, 2012.

(51) Int. Cl.
*E04H 12/02* (2006.01)

(52) U.S. Cl.
CPC ..... *E04H 12/02* (2013.01)

(58) Field of Classification Search
CPC ..... E04B 1/78; E04B 2/7809; E04C 3/00; E04C 3/28; E04C 3/36; E04C 12/02; B29L 2031/766; E04H 12/02
USPC ..... 52/40, 110, 835
See application file for complete search history.

(56) References Cited

U.S. PATENT DOCUMENTS

| | | | | | |
|---|---|---|---|---|---|
| 3,281,299 | A * | 10/1966 | Shobert | 156/175 |
| 3,490,983 | A * | 1/1970 | Lee | 428/113 |
| 3,574,104 | A * | 4/1971 | Medler | 428/222 |
| 3,709,754 | A * | 1/1973 | Medler | 156/161 |
| 3,974,012 | A * | 8/1976 | Hogarth | 428/34.5 |
| 4,172,175 | A * | 10/1979 | Pearson et al. | 428/376 |
| 4,417,937 | A * | 11/1983 | Escher et al. | 156/169 |
| 4,918,883 | A * | 4/1990 | Owen et al. | 52/835 |
| 5,492,579 | A * | 2/1996 | Hosford et al. | 156/64 |
| 5,633,057 | A * | 5/1997 | Fawley | 428/36.1 |
| 5,910,458 | A * | 6/1999 | Beer et al. | 442/367 |
| 6,250,193 | B1 * | 6/2001 | Head | 87/2 |
| 6,367,225 | B1 * | 4/2002 | Ashton | 52/834 |
| 6,453,635 | B1 * | 9/2002 | Turner | 52/848 |
| 8,883,060 | B2 * | 11/2014 | Nakamura et al. | 264/258 |
| 2006/0218873 | A1 * | 10/2006 | Christensen et al. | 52/737.1 |
| 2010/0101130 | A1 * | 4/2010 | Boyce | 40/607.01 |
| 2011/0135423 | A1 * | 6/2011 | Williams | 414/23 |

* cited by examiner

*Primary Examiner* — Elizabeth A Plummer
(74) *Attorney, Agent, or Firm* — Gordon Rees Scully Mansukhani LLP; Reid E. Dammann

(57) ABSTRACT

A fiber glass utility pole comprising: (a) a center section that comprises from 5% to 15% of the total diameter of the utility pole; (b) a mid-section surrounding the center section, the mid-section comprising from 70% to 90% of the total diameter of the utility pole; and (c) an outer section surrounding the mid-section, the outer section comprising from 5% to 15% of the total diameter of the utility pole, wherein the center section comprises fiber glass oriented at a 30 to 60 degree angle to a center axis, and wherein the mid-section comprises fiber glass oriented parallel to the center axis, and wherein the outer section comprises fiber glass oriented at a 30 to 60 degree angle to a center axis.

11 Claims, 5 Drawing Sheets

COMPOSITION FIBER GLASS UTILITY POLE

RELATED APPLICATION

The present invention relates to environmentally friendly fiberglass utility poles. The present invention claims priority to U.S. Provisional Patent Application 61/710,643, filed Oct. 5, 2012, entitled IMPROVED COMPOSITION FIBER GLASS UTILITY POLE, the entire disclosure of which is incorporated herein by reference in its entirety.

TECHNICAL FIELD

The present invention relates to environmentally friendly fiberglass utility poles.

BACKGROUND OF THE INVENTION

Most utility poles used today made of wood. Such wooden poles are pressure treated to preserve them from the weather, insects and other types of attacks and decay. Specifically, they are treated with a number of toxic chemicals including pentachlorphenol, chromated copper arsenate, creosote, copper azole and others. Pentachlorophenol (Penta) is widely-used wood preservative that is normally dissolved in a petroleum carrier. It is the most commonly used preservative system utilized by North American utilities. Chromated Copper Arsenate (CCA) is water-borne treatment that offers a wide range of advantages for treated lumber, timber and poles; clean; odorless; paintable. For poles, its use is limited to southern yellow pine, pinus sylvestris, and western red cedar. Creosote is an oil-based wood preservative blended from the distillation of coal tar and comprised of more than 200 major constituents. Used in industrial applications, such as railroad ties, piling (both salt water and fresh water), and for utility poles. Copper Azole (CA-B) is a water-borne copper based wood preservative with an organic co-biocide (Tebuconazol). Similar in color, to CCA-C, odorless, clean, paintable or stainable. Copper Azole is approved by the American Wood Preservers Association for use on Western Red Cedar and Southern Yellow Pine utility poles. These chemicals that are harmful to the environment, and poisonous (e.g. arsenic, etc.) to humans and animals and have been shown in some instance to cause cancers. Another problem is that even with pressure treating the wood, wooden utility poles have to be replaced about every ten years. Another problem is that wooden utility poles are not aesthetically pleasing to look and are typically all a brown or black color.

It would instead be desirable to produce utility poles that do not require the above described chemical treatments. Ideally, it would be desired to provide a utility pole that does not require any of the standard chemical treatments since these chemicals listed above are all somewhat environmentally unfriendly.

Many of the above problems have been overcome by fiber glass utility poles. However, it would be desirable to ensure that such fiber glass poles are sufficiently strong and long lasting, without requiring them to be excessively thick, such that they don't consume a large amount of material. What is instead desired is a fiber glass utility pole having added strength with reduced mass. As will be shown the present invention provides such a strong system.

SUMMARY OF THE INVENTION

The present invention provides a fiber glass utility pole having improved strength as compared to existing designs.

In one aspect, the present invention provides a hollow fiber glass utility pole comprising: (a) a center section; (b) a mid-section surrounding the center section; and (c) an outer section surrounding the mid-section, wherein the center section comprises fiber glass oriented at an angle to a center axis, and wherein the mid-section comprises fiber glass oriented parallel to the center axis, and wherein the outer section comprises fiber glass oriented at an angle to a center axis.

Preferably, the center section comprises from 5% to 15% of the total diameter of the utility pole, and wherein the mid-section comprises from 70% to 90% of the total diameter of the utility pole, and wherein the outer section comprises from 5% to 15% of the total diameter of the utility pole.

Most preferably, the angle at which the fiber glass in the center and outer sections is oriented to the center axis is 45 degrees.

DETAILED DESCRIPTION OF THE DRAWINGS

Figure 1:
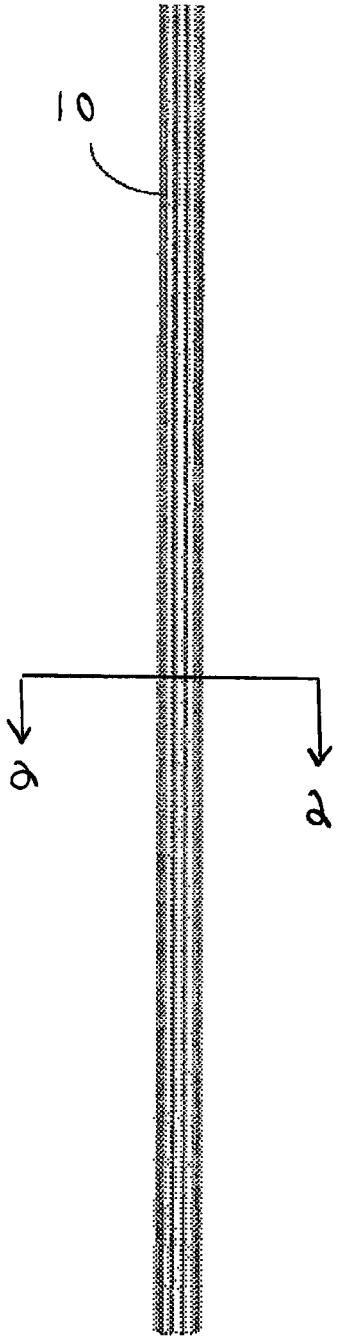
FIG. 1 is a side elevation view of a fiber glass utility pole according to the present invention.
Figure 2:
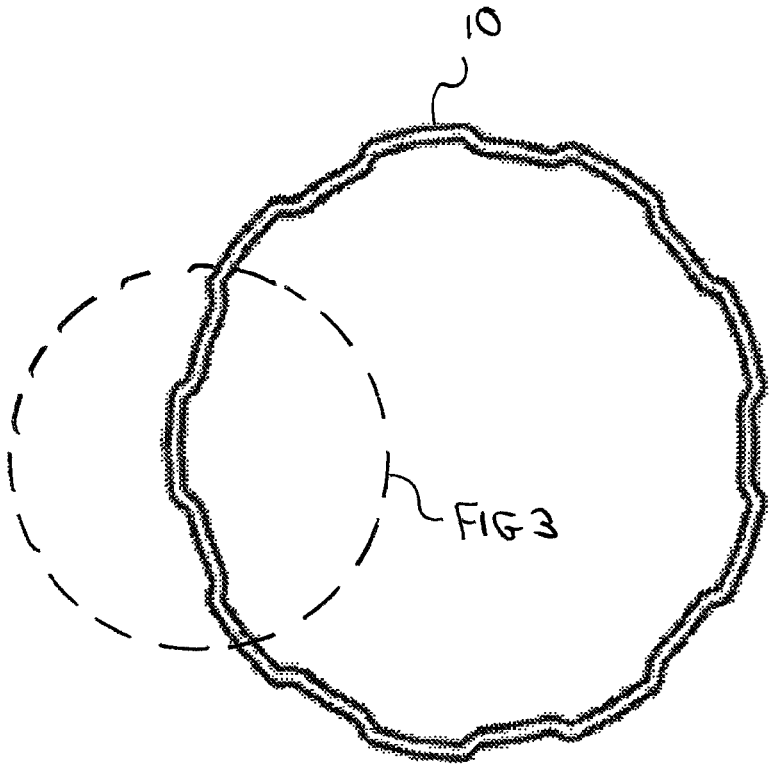
FIG. 2 is a top plan view of the longitudinal section of a first embodiment of a fiber glass utility pole taken along line 2-2 in FIG. 1.
Figure 3:
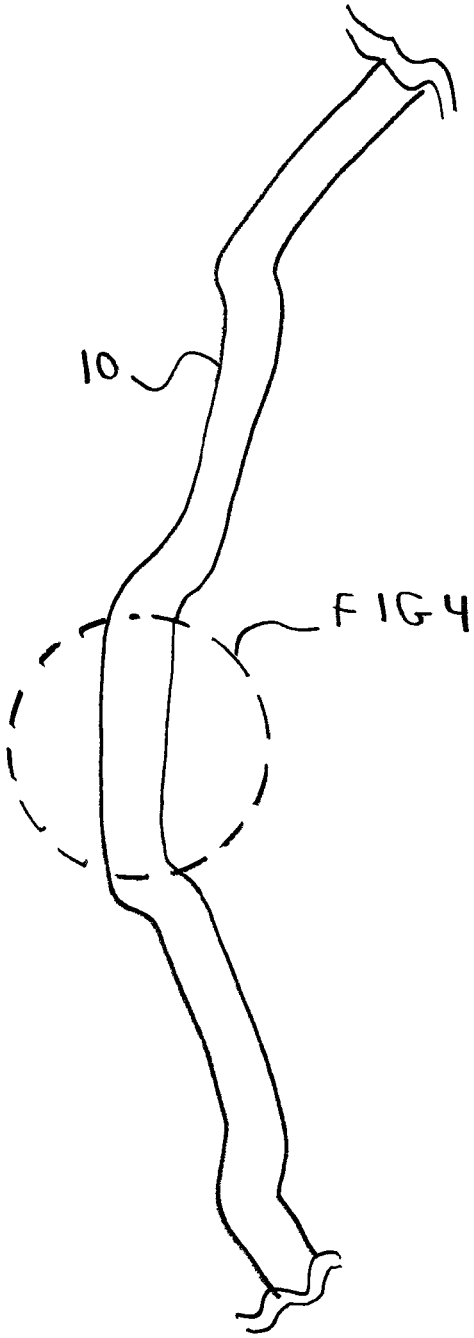
FIG. 3 is a close up view of a portion of FIG. 2.
Figure 4:
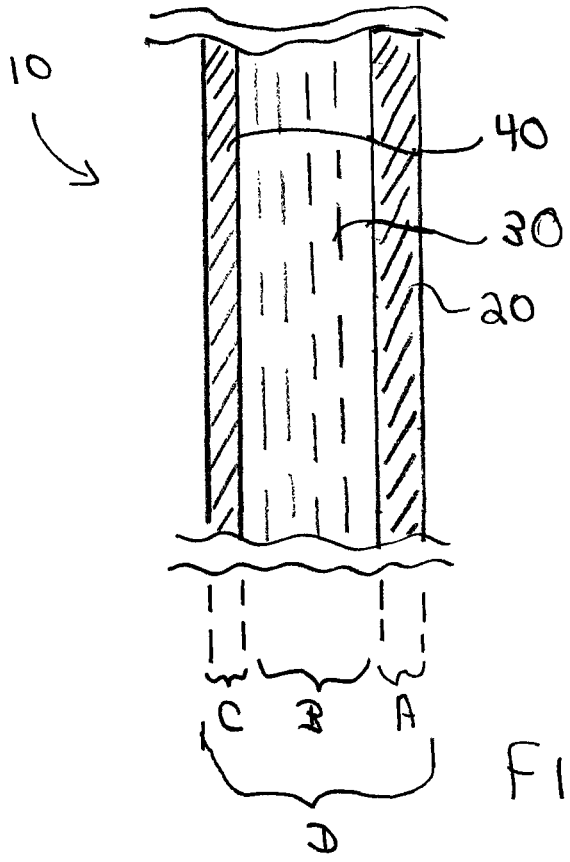
FIG. 4 is a close up view of a portion of FIG. 3 (showing the center, mid and outer sections of the pole).

FIG. 1 is a perspective view of fiber glass utility pole 10. FIG. 2 is a top plan view across the hollow utility pole. FIGS. 3 and 4 are progressive close up views. As can be seen in FIG. 4, the utility pole is made from three sections, being a center section 20, a mid-section 30 and an outer section 40.

In accordance with the present invention, each of the inner and outer sections 20 and 40 of the utility pole comprise about 10% (i.e.: 5% to 15%) of the diameter across the pole and the mid-section comprises about 80% (i.e.: 70% to 90%) of the diameter across the pole. Referring to FIG. 4, this means that distance A is about 10% (i.e.: 5% to 15%) of total distance D. Similarly, distance C is about 10% (i.e.: 5% to 15%) of total distance D. Distance B is about 80% (i.e.: 70% to 90%) of distance D.

FIG. 4 illustrates the orientation of the fiberglass in each of the three sections. As can be seen, in mid-section 30, the fiberglass is oriented along the length of the pole (i.e.: straight up and down parallel to center axis Z). However, in each of inner section 20 and outer section 40, the fiberglass is oriented at about 45 degrees to the length of the pole (i.e.: at a 45 degree angle to center axis Z). More generally, however, the angle can be from 30 to 60 degrees, all keeping within the scope of the present invention.

Figure 5:
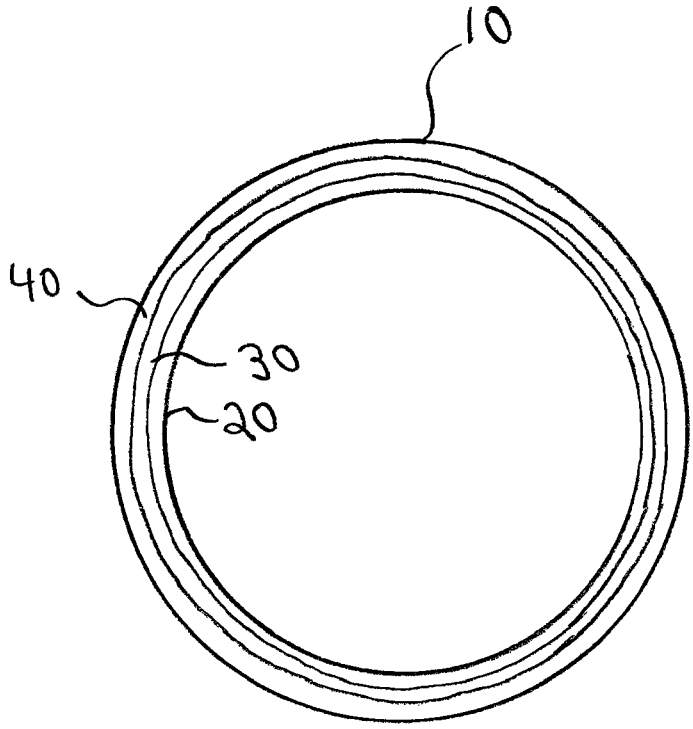
FIG. 5 is a top plan view of the longitudinal section of a second embodiment of a fiber glass utility pole taken along line 2-2 in FIG. 1.

FIG. 5 illustrates an embodiment of the invention in which the sections of the utility pole are round as opposed to being wavy as seen in the embodiments of FIGS. 2 and 3. It is to be understood that the present invention encompasses both embodiments.

The present inventor has found through experimentation that the above-described fiberglass utility pole offers added strength.

The present fiber glass material offers the advantages of being safe, aesthetically pleasing, resistant to damage and corrosion (from weather, animals, insects, etc.). The present utility pole is light weight, high strength, corrosion/rot resistant, non-conductive, electro-magnetically transparent, dimensionally stabile, low temperature capable, and aesthetically pleasing. In addition, it can be made in different colors.

In preferred embodiments, pole 10 is made of fiberglass. Optionally, it may be made of a suitable thermoset resin, including but not limited to polyvinyl chloride. In some cases (such as fiber reinforced tubes) the extrudate is pulled through a very long die, in a process called "pultrusion." As is known in the art, "pultrusion" is a manufacturing process for producing continuous lengths of materials. Pultrusion raw materials include a liquid resin mixture (e.g., containing resin, fillers and specialized additives) and reinforcing fibers (e.g., fiberglass, composite materials, etc.). The process involves pulling these raw materials (rather than pushing as is the case in extrusion) through a heated steel forming die using a continuous pulling device. The reinforcement materials are in continuous forms such as rolls of fiberglass mat or doffs of fiberglass roving. As the reinforcements are saturated with the resin mixture in the resin impregnator and pulled through the die, the gelation (or hardening) of the resin is initiated by the heat from the die and a rigid, cured profile is formed that corresponds to the shape of the die.

There are also protruded laminates. Most pultruded laminates are formed using rovings aligned down the major axis of the part. Various continuous strand mats, fabrics (e.g., braided, woven and knitted), and texturized or bulked rovings are used to obtain strength in the cross axis or transverse direction.

The pultriusion process is normally continuous and highly automated. Reinforcement materials, such as roving, mat or fabrics, are positioned in a specific location using preforming shapers or guides to form a pultruson. The reinforcements are drawn through a resin bath where the material is thoroughly coated or impregnated with a liquid thermosetting resin. The resin-saturated reinforcements enter a heated metal pultrusion die. The dimensions and shape of the die define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

In one embodiment the pultrusion resins include bisphenol-a epichlorohydrin-based vinyl esters. In another embodiment, the resins include polyesters including isophthalic, orthophthalic, propylene-maleate, fire resistant, and high cross-link density. However, the present invention is not limited to these resins and other resins can be used to practice the invention.

In one embodiment, the pultrusions include re-enforcing fibers comprising, fiberglass fibers, composite fibers, etc. However, the present invention is not limited to these resins and other resins can be used to practice the invention.

One resin used in fiberglass pultrusions is a thermoset resin. The resin used in Polyvinyl Chloride (PVC) pultrusions are typical thermoplastic resins. In the pultrusion process, under heat and pressure, the thermoset resins and re-enforcing fibers form a new inert material that is impervious to temperature. Pultruded fiberglass physical properties do not change through the full temperature cycle up to temperatures of about 200 degrees Fahrenheit (.degree. F.). In direct contrast, PVC resins typically become unstable at temperatures greater than 155.degree. F.

Pultrusions, include but are not limited to, structures comprising: (1) HIGH STRENGTH—typically stronger than structural steel on a pound-for-pound basis; (2) LIGHTWEIGHT—Pultrusions are 20-25% the weight of steel and 70% the weight of aluminum. Pultruded products are easily transported, handled and lifted into place; (3) CORROSION/ROT RESISTANT—Pultruded products will not rot and are impervious to a broad range of corrosive elements; (4) NON-CONDUCTIVE—fiberglass reinforced pultrusions have low thermal conductivity and are electrically non-conductive; (5) ELECTRO-MAGNETIC TRANSPARENT—Pultruded products are transparent to radio waves, microwaves and other electromagnetic frequencies; (6) DIMENSIONAL STABILE—The coefficient of thermal expansion of pultruded products is slightly less than steel and significantly less than aluminum; (7) LOW TEMPERATURE CAPABLE—FiberGlass fiber reinforced pultrusions exhibit excellent mechanical properties at very low temperatures, even −70.degree. F. Tensile strength and impact strengths are greater at −70.degree. F. than at +80.degree. F.; and (8) AESTHETICLY PLEASING—Pultruded profiles are pigmented throughout the thickness of the part and can be made to virtually any desired custom color. Special surfacing veils are also available to create special surface appearances such as wood grain, marble, granite, etc.

In one embodiment, pole 10 comprises extruded plastic materials including, but not limited to, Polyvinyl Chloride (PVC), Acrylonitrile Butadiene Styrene (ABS), High Impact Polypropylene (HIP), Polypropylene, High-Density Polyethylene (HDPE), Polycarbonate, Polyethylene Terephthalate Glycol (PETG), Nylon, Fiber reinforced Polypropylene, Fiber Reinforced Plystyrene and other types of plastics. In another embodiment, the pole sections comprise composite materials. In another embodiment, the pole sections comprise recycled plastic materials. Preferably, the pole sections can be made in different colors (e.g., red, green, yellow, blue, brown, etc.) to be aesthetically pleasing. Such plural different colors may blend in with a natural environmental setting or a predetermined design scheme. For example, a new subdivision may include only blue extruded utility poles, while a boat dock may include only high visibility orange poles. However, the present invention is not limited to these colors and other colors can be used to practice the invention.

In optional embodiments, additional filaments or webbing (including fiberglass, plastic, ester, polyester, nylon, and composite materials) may be added internally or externally to add strength.

What is claimed is:

1. A hollow pultruded fiber glass utility pole comprising:

(a) a center section comprising fiber glass oriented at an angle to a center axis, the center section comprising from 5% to 15% of a total diameter of the utility pole;

(b) a mid-section surrounding the center section, the mid-section comprising fiber glass oriented parallel to the center axis, the mid-section comprising 70% to 90% of the total diameter of the utility pole; and (c) an outer section surrounding the mid-section, the outer section comprising fiber glass oriented at an angle to a center axis, the outer section comprising 5% to 15% of the total diameter of the utility pole wherein the center, mid- and outer sections of the hollow pultruded fiber glass utility pole are pulled through a continuous pulling device.

2. The hollow pultruded fiber glass utility pole of claim 1, wherein the center section comprises about 10% of the total diameter of the utility pole, wherein the mid-section comprises about 80% of the total diameter of the utility pole, and wherein the outer section comprises about 10% of the total diameter of the utility pole.

3. The hollow pultruded fiber glass utility pole of claim 1, wherein the angle at which fibers in the fiber glass in the center and outer sections are oriented to the center axis is 45 degrees.

4. The hollow pultruded fiber glass utility pole of claim 1, wherein the angle at which fibers in the fiber glass in the center and outer sections are oriented to the center axis is from 30 to 60 degrees.

5. The hollow pultruded fiber glass utility pole of claim 1, wherein each of the center, mid-, and outer sections are of continuous lengths that are pulled through the continuous pulling device, the continuous pulling device being a heated steel forming die.

6. The hollow pultruded fiber glass utility pole of claim 5, wherein each of the center, mid-, and outer sections comprise roving, mat, or fabrics.

7. The hollow pultruded fiber glass utility pole of claim 5, further comprising a pultrusion resin impregnated in the center, mid-, and outer sections, the pultrusion resin including bisphenol-a epichlorohydrin-based vinyl ester or a thermoset resin.

8. The hollow pultruded fiber glass utility pole of claim 5, further comprising a pultrusion resin impregnated in the center, mid-, and outer sections, the pultrusion resin including isophthalic, orthophthalic, propylene-maleate, fire resistant, or high cross-link density resin-based esters.

9. The hollow pultruded fiber glass utility pole of claim 1, wherein the utility pole is not used with a wooden utility pole.

10. The hollow pultruded fiber glass utility pole of claim 9, wherein the utility pole does not use chemical treatments or toxic chemicals for treatment of wood that are environmentally unfriendly.

11. A hollow pultruded fiber glass utility pole comprising:

(a) a pultruded center section comprising fiber glass oriented at an angle to a center axis, the center section comprising from 5% to 15% of a total diameter of the utility pole;

(b) a pultruded mid-section surrounding the center section, the mid-section comprising fiber glass oriented parallel to the center axis, the mid-section comprising 70% to 90% of the total diameter of the utility pole; and (c) an pultruded outer section surrounding the mid-section, the outer section comprising fiber glass oriented at an angle to a center axis, the outer section comprising 5% to 15% of the total diameter of the utility pole.

* * * * *